US005161624A

United States Patent [19]

Beck et al.

[11] Patent Number: 5,161,624

[45] Date of Patent: Nov. 10, 1992

[54] TOOL FOR DRIVING FASTENING ELEMENTS INTO HARD RECEIVING MATERIALS

[75] Inventors: Josef Beck, Vaduz, Liechtenstein; Fritz Mark, Mäder; Michael Maier, Feldkirch-Tisis, both of Austria

[73] Assignee: Hilti Aktiengesellschaft, Furstentum, Liechtenstein

[21] Appl. No.: 671,512

[22] Filed: Mar. 19, 1991

[30] Foreign Application Priority Data

Mar. 19, 1990 [DE] Fed. Rep. of Germany ..... 4008750

[51] Int. Cl.[5] ..... B25D 11/04

[52] U.S. Cl. ..... 173/47; 173/105; 173/133

[58] Field of Search ..... 173/104, 105, 108, 132, 173/133, 47; 227/10

[56] References Cited

U.S. PATENT DOCUMENTS

| | | | |
|---|---|---|---|
| 2,929,134 | 3/1960 | Mosher | 173/104 |
| 3,370,655 | 2/1968 | Chromy | 173/132 |
| 3,385,378 | 5/1968 | Weber et al. | 173/47 |
| 3,403,738 | 10/1968 | Burkhart et al. | 173/105 |
| 3,620,312 | 11/1971 | Krasnoff | 173/105 |
| 3,640,351 | 2/1972 | Coyne et al. | 173/105 |
| 3,866,692 | 2/1975 | Stelljes | 173/133 |
| 4,134,460 | 1/1979 | Klemm | 173/105 |
| 4,239,143 | 12/1980 | Johnson | 173/133 |

*Primary Examiner*—Douglas D. Watts
*Assistant Examiner*—Scott A. Smith
*Attorney, Agent, or Firm*—Anderson Kill Olick & Oshinsky

[57] ABSTRACT

Tool for driving fastening elements into a hard receiving material, such as concrete, masonry, rock and the like, has a first device (1) for drilling a fastening element into the hard material and a second device (2) for axially propelling the fastening element into the receiving material after it has been partly drilled in. The first device (1) provides a borehole in the hard receiving material by applying rotary movement to the fastening element, possibly with the addition of axially directed striking force. The second device (2) completes the insertion of the fastening element into the receiving material by directing an axial force produced by high pressure gases against the partly drilled in fastening element.

13 Claims, 2 Drawing Sheets

TOOL FOR DRIVING FASTENING ELEMENTS INTO HARD RECEIVING MATERIALS

BACKGROUND OF THE INVENTION

The present invention is directed to a tool for driving fastening elements into hard receiving materials, such as concrete, masonry, rock and the like.

Driving in fastening elements in the manner of direct assembly has the advantage of being economical with respect to time on one hand, particularly in mass fastenings, but, on the other hand, there is the disadvantage that crater-like spalling can result in the surface of the receiving material. To prevent such spalling, in DE-PS 28 49 139 a method is suggested in which the fastening element is driven into the receiving material through the base of a preformed borehole by means of an explosive powder charge. The disadvantage of this method involves its high cost with respect to time and handling.

SUMMARY OF THE INVENTION

Therefore, it is the primary object of the present invention to provide a tool for driving fastening elements into a hard receiving material at low cost with respect to time and handling while avoiding the possibility of spalling.

In accordance with the present invention, the tool combines a rotary drilling device and a fastening element driving device.

Fastening elements can be driven into hard receiving materials using this tool where the rotary drilling produces a borehole in the receiving material and, subsequently, the fastening elements are fully driven in by the driving device using high-pressure gases.

The rotary drilling device is driven by a motor, such as an electric motor powered by a battery in the tool or from a separate source of current. Advantageously, the fastening element driving device is operated in a known manner using high-pressure gases, for instance the gases generated in the ignition of an explosive powder charge.

A receiving body is arranged to receive the fastening elements so that they are secured for rotation with and are axially displaceable relative to the receiving body. In this arrangement, it is possible for the fastening elements to cooperate fully with all parts of the receiving body for effecting rotation of the fastening or it is possible for parts of the fastening elements to cooperate with an additional element supported in the receiving body.

The fastening elements cooperate fully with all parts of the tool housing, preferably a driving member is provided in the receiving body for receiving the fastening elements so that the fastening elements are held for rotation with the receiving body. The driving member is formed with a polygonal contour in the receiving body so that a corresponding polygonally shaped part, such as a head or guide disk, of the fastening element engages in the driving member.

Advantageously, the receiving body is connected with a drive member so that it rotates with the drive member and is axially displaceable relative to it. The drive member can be set in rotating motion by the rotary drilling device. The receiving body and the drive member engage one another, for instance by correspondingly shaped surfaces, for connecting the receiving body and the drive member so that they rotate as a unit but are axially displaceable relative to one another. The displaceability of the drive member relative to the receiving body permits the transmission of percussive blows to the receiving body when the drive member is not axially displaced.

In a preferred arrangement, the receiving body is acted upon by a striker of a cam striking mechanism forming part of the rotary drilling device for achieving high drilling progress even with low contact pressure force of the device. The blows conveyed from the striker to the receiving body are transmitted to the fastening elements and are superposed on the rotary motion of the fastening elements.

The cam striking mechanism can work according to the spring lift principle with the mutually cooperating cam rings located at facing ends of the drive member and the striker.

In another advantageous feature, the receiving body has an axially extending bore for the passage of part of a driving piston of the bolt driving device with the driving piston being set in axial motion by the propelling force of an explosive powder charge. As a result, the driving piston can drive the fastening elements with a part projecting through the bore, such as a shaft or shank. After a drilling depth corresponding to approximately half the length of the shank of the fastening element is attained, the fastening element can be driven axially into the fully inserted position.

In one embodiment, an anvil can be connected with the receiving body so that it rotates with the body and is axially displaceable relative to it, whereby the anvil can be acted upon by the driving piston and cooperate with parts of the fastening element inserted into the anvil bore, especially when fastening elements in the form of threaded bolts are used. In this way, the axial movement of the driving piston can be transmitted to the fastening elements by way of the anvil with the anvil being axially displaced along with the fastening element relative to the receiving body. Rotational movement can be transmitted from the receiving body through the anvil to the fastening elements, whereby the anvil has a driving member for receiving the fastening elements so that the fastening elements are fixed against rotation relative to the anvil. The driving member can be formed as a polygonal recess in the anvil bore with a similar polygonally shaped part on the rear end of the fastening element engaging into such recess.

Preferably, the striker and driving piston penetrate axially through an opening in the drive member which opens toward the receiving body. The driving piston is guided coaxially in a through borehole of the striker so as to be axially displaceable. The blows of the striker and the driving force of the driving piston can be transmitted directly and centrically to the receiving body or anvil or to the fastening element. The fastening elements, which can be driven in by the tool and connected to the receiving body so that they rotate with the body and are axially displaceable relative to it, preferably comprise a drill head at the leading end of the fastening element shank and load application means at the trailing end of the shank, affording connection with the receiving body so that the fastening element and the receiving body rotate as a unit.

The tool is used for driving fastening elements preferably provided with a drill head at the leading end of the shank, load application means at the trailing end of the shank, and rotary driving means. The drill head of the fastening elements can be formed as a unitary part of the shank or as an inserted hard metal plate or a crown of wear-resistant material. A portion on the shank in the form of a thread or a head projecting outwardly from the diameter of the shank can be used as the load application means. A part with a polygonal cross-section is suitable for use as the rotary driving means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
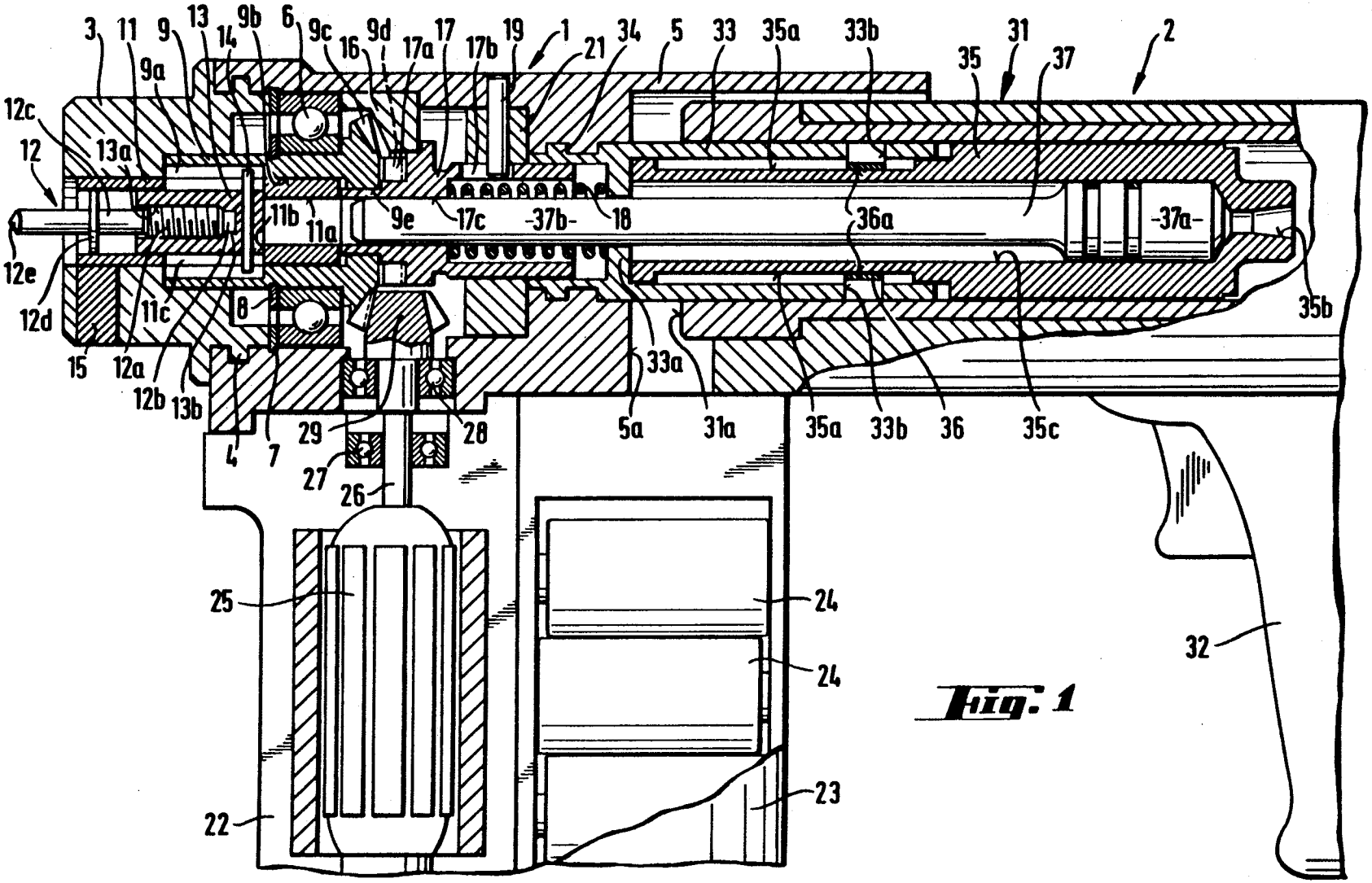
FIG. 1 is a partial view of a tool embodying the present invention, with an inserted fastening element, the tool is shown partly in section and in the rest position, and with a motor region of the tool illustrated in a simplified manner.

The tool displayed in FIG. 1 combines a rotary drilling device 1 and a fastening element driving device 2 in a single unit.

Figure 2:
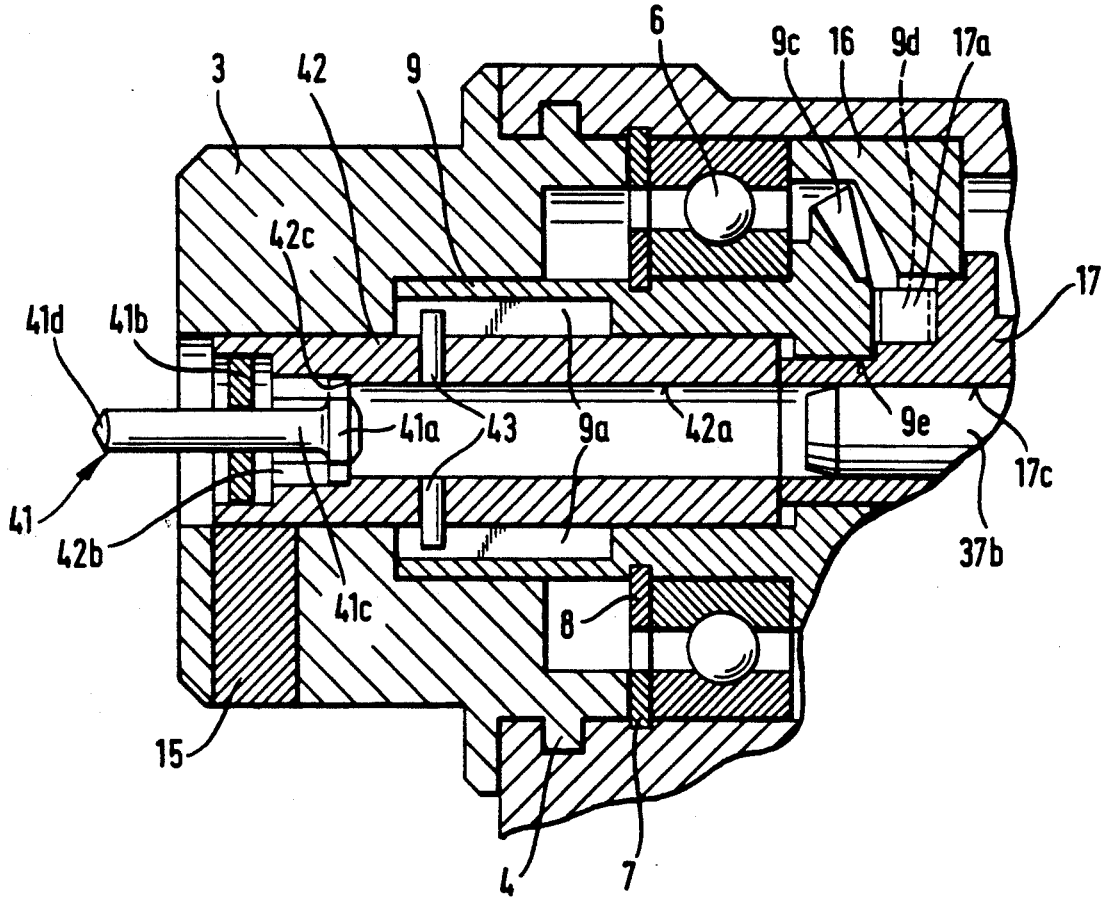
FIG. 2 is an axially extending sectional view of the front region of a tool displaying another arrangement of the tool shown in FIG. 1, on an enlarged scale relative to FIG. 1 and in the rest position of the tool.

As viewed in FIGS. 1 and 2, the leading end of the tool and of its operating parts is to the left and the trailing end is to the right. At the leading end of the tool, a flange like part 3 with a open bore extending in the axial or driving direction is detachably coupled with a carrier 5 of the rotary drilling device 1 via a bayonet-type connection 4. The part 3 and the carrier 5 combine to form a part of the tool housing. At the trailing end of the part 3 a ball bearing 6 is axially supported in the driving direction by two retaining disks (7, 8) in the leading end region of the carrier 5. Ball bearing 6 rotatably supports a drive member 9 in which a receiving body 11 for a fastening element in the form of a threaded bolt 12 is located. At the leading end of the receiving body 11, there is an anvil 13 within the part 3. Anvil 13 is supported at its trailing end by an annular shoulder **11*b* on the receiving body 11 and is displaceably supported in a central bore 11*a* in the receiving body 11. A pin 14 extending transversely of the axial driving direction connects the anvil 13 with the receiving body 11 and the drive member 9, so that it rotates with them. The pin 14 is secured in the anvil 13 and engages in slots 11*c* in the receiving body 11 and in axially extending grooves 9*a* in the drive member 9. A bore 13*a* extends from the leading end toward the trailing end of the anvil 13 and a drive member 13*b* in the form of a four-sided recess is provided at the closed trailing end of the bore 13*a***.

The trailing part of threaded fastening element bolt 12 extends into the leading end of the bore **11*a* in the receiving body 11 and extends into the bore 13*a* in the anvil 13 so that its threaded portion 12*a* is located within the anvil bore 13*a* and the trailing end of the bolt has a four-sided projection 12*b* which fits into the drive member 13*b*. The interengagement of the projection 12*b* within the recess forming the drive member 13*b*** holds the fastening element so that it rotates with the anvil.

Within the bore **11*a* in the receiving body 11 between the anvil and the leading end of the tool there is a guide disk 12*d* on the shank 12*c* of the threaded bolt 12. A drilling head 12*e* is located at the leading end of the shank 12*c*. A permanent magnet 15, in cooperation with the guide disk 12*d*, holds the threaded bolt 12 against axial movement relative to the part 3. Mechanical retaining means can be used in place of the permanent magnet 15**.

At its trailing end, drive member 9 has a bevel gear ring **9*c* and a cam ring 9*d*** with saw tooth-shaped cams.

A supporting ring 16, partially open in the circumferential direction, is secured in the carrier 5 at the trailing end of the drive member 9. A striker 17 is located within the ring 16 and extends toward the trailing end of the tool. The striker 17 is supported or biased in the driving direction by a pressure spring 18. Striker 17 includes a cam ring **17*a* with saw toothed-shaped cams which cooperate or intermesh with cams on the cam ring 9*d*. In the rest position of the tool, as illustrated, the cams of the cam rings project into the recesses of the other cam ring. A collar at the leading end of the striker 17 extends partially into an opening 9*e* in the drive member 9 and projects into a borehole 9*b* containing the receiving body 11. To guide the striker 17 so that it does not rotate but is axially displaceable, the striker has an axially extending groove 17*b* with a pin 19 extending into the groove. Pin 19 is secured in the carrier 5 and extends radially inwardly from the carrier through a ring 21**.

Mounted on the carrier 5 is a motor housing 22 and another housing 23 for batteries 24 for supplying current to an electric motor 25. Electric motor 25 has a rotor shaft 26 extending transversely of the driving direction and guided in bearings 27, 28. A bevel pinion 29 is located at the upper end of the rotor shaft 26. Bevel pin 29 meshes with the bevel gear ring **9*c* on the drive member 9**.

The fastening element driving device 2 is located within another portion 31 of the tool housing made up of two parts and including a handle 32 with an operating trigger located at the trailing end of the tool. The elements used for firing the explosive power charge, and for feeding the explosive powder charges in cartridge form, are known in fastening element driving devices, and, therefore, for reasons of simplicity are not illustrated. These elements are located in the region of the housing portion 31 not shown. A carrying tube 33 is coupled at its leading end with the carrier 5 by a bayonet-type connection 34 for detaching the fastening element driving device 2 from the rotary drilling device 1. The carrying tube projects out of the leading end of the portion 31 so that it is displaceable relative to the portion. An axially extending guide tube 35 is located within the carrying tube 33 and is pressed against a base **33*a* of the tube by spring force and extends axially toward the trailing end of the tool. Adjacent the base 33*a*, the guide tube 35 is provided with axially extending flattened portions 35*a* defined at the leading and trailing ends by shoulders for limiting the axial displaceability of the guide tube 35, and a U-shaped stirrup 36 has legs 36*a* contacting the flattened portions 35*a*. The stirrup 36 is supported in slots 33*b* so that the stirrup is not axially displaceable. The trailing end of the guide tube 35 forms a cartridge chamber 35*b* for receiving explosive powder charges. The cartridge chamber 35*b* opens at its leading end into a guide tube borehole 35*c* in which a driving piston 37, with a head 37*a*** at its trailing end, is axially displaceable and is supported by the borehole. A shaft 37*b* of the driving piston 37 extends axially in the driving direction from the head 37*a* through the borehole 35*c* into the through borehole 17*c* of the striker 17. The leading end of the driving piston 37 is axially displaceable through the bore 11*a* toward the trailing end of the anvil 13.

In the illustrated rest position of the tool in FIG. 1, the leading end 31*a* of the housing portion 31 is spaced rearwardly from a supporting surface 5*a* of the carrier facing toward the trailing end of the tool.

To drive the threaded fastening element or bolt 12 into a receiving material, the fastening element, inserted into the receiving body 11 is pressed against the receiving material by means of the tool and the motor 25 is switched on. The switched on motor 25 rotates the drive member and the rotational motion is conveyed to the receiving body 11 and the anvil 13 by way of the transversely extending pin 14. The drive member 13*b* of the anvil 13 transmits the rotational motion to the threaded fastening element 12. The rotation of the drive member 9 also causes the cam toothed ring 9*d* to run up against the cam toothed ring 17*a* of the striker 17 which is held stationary in the rotational direction. As a result, the striker 17 executes an axially directed reciprocating motion in cooperation with the pressure spring 18 and directs successive percussive blows against the receiving body 11. Receiving body 11 is held in the striking region of the striker 17 by the contact pressure of the tool. The blows directed against the receiving body 11 are transmitted by it, via the shoulder 11*b*, to the trailing end of the anvil 13 which, in turn, transmits them to the threaded fastening element 12 for effecting the drilling in operation.

After the fastening element 12 has been drilled into the receiving material for approximately half the length of its shank 12*c*, the motor 25 is switched off. The explosive powder charge is then ignited and the driving piston is propelled against the anvil 13 by the gases generated. As a result of the impact of the driving piston 37, the anvil 13 propels the threaded fastening element 12 further into the receiving material through the base of the borehole formed in the drilling in operation. Accordingly, the insertion of the fastening element is completed.

In FIG. 2 the front region of another tool is shown which makes it possible to drive nails 41 instead of the threaded fastening elements 12 as illustrated in FIG. 1. With the exception of the parts adapted for receiving a nail 41 the other parts of the tool are the same as in FIG. 1 and, therefore, have the same reference numerals.

Receiving body 42 is connected to the drive member 9 so as to be displaceable and fixed with respect to rotation by means of the transversely extending pins 43 secured to the receiving body 42 and extending radially outwardly into the axially extending grooves 9*a* of the drive member. A bore 42*a* extends axially through the receiving body 42 so that the shaft 37*a* of the driving piston can pass through it and contact the nail 41. The receiving body 42 is supported at its trailing end against the striker 17. The receiving body 42 has a drive member 42*b* with a polygonal shape for receiving a similarly shaped nail head 41*a* so that the receiving body 42 rotates the nail. A disk 41*b* is positioned on the shank 41*c* of the nail and bears against an enlarged portion of the bore 42*a* so that the disk serves as a second guide for the nail. A drill head 41*d* is located at the leading end of the shank 41*c* of the nail.

As in the case of the threaded fastening element 12, the nail 41 is driven into a receiving material in the first phase by a drilling process with superposed intermittent percussive action. The rotational movement is transmitted from the drive member 9 via the transversely extending pins 43 to the receiving body 42 and through the drive member 42*b* to the nail 41. The percussive blows intermittently conveyed to the receiving body 42 via the striker 17 are transmitted to the nail via a shoulder 42*c* in contact with the nail head 41*a*. When the drilling process is completed, the nail is completely driven into the receiving material in a second phase by the force generated by the ignition of an explosive powder charge, wherein the driving piston penetrates through the recess 42*a* by means of its shaft 37*b* and strikes the nail 41 completely inserting it into the receiving material.

While specific embodiments of the invention have been shown and described in detail to illustrate the application of the inventive principles, it will be understood that the invention may be embodied otherwise without departing from such principles.

We claim:

1. Tool for driving axially extending fastening elements into a hard receiving material, such as concrete, masonry, rock and the like, wherein the improvement comprises first means (1) for rotating and at the same time directing percussion blows against a fastening element for drilling at least an axially extending part of the fastening element into the receiving material, and a separate second means (2) for further axially driving the fastening element into the receiving material after the fastening element has been drilled into the receiving material.

2. Tool, as set forth in claim 1, wherein said first means comprises a receiving body (11, 42) arranged to receive the fastening element (12, 41) so that the fastening element rotates with the receiving body and is axially displaceable relative to the receiving body.

3. Tool, as set forth in claim 2, wherein said receiving body comprises at least one driving member (13*b*, 42*b*) for interengagement with the fastening element (12, 41) so that the fastening element is secured for rotation with the receiving body.

4. Tool, as set forth in claim 3, wherein said receiving body (11, 42) is connected with a drive member (9) for rotating with the drive member and for applying axially directed percussion blows for axially displacing the fastening element relative to the drive member, and said first means comprises a drive motor engageable with said drive member for rotating said drive member (9).

5. Tool, as set forth in claim 4, wherein said receiving body (11) is acted on by a striker (17) of a cam striking mechanism driven by said drive motor.

6. Tool, as set forth in claim 3, wherein said receiving body (11) has an axially extending bore (11*a*, 42*a*), and said second means comprises a driving piston (37) having an axially extending shaft (37*b*) with the shaft (37*b*) being axially displaceable through said bore (11*a*, 42*a*) when said driving piston (37) is displaced axially by high-pressure gases developed by ignition of an explosive powder charge.

7. Tool, as set forth in claim 6, wherein an anvil (13) is located within said bore (11*a*, 42*a*) and is fixed to said receiving body (11) so that said anvil rotates with said receiving body and is axially displaceable relative to said receiving body, and said driving piston (37) being arranged to be axially displaceable through said bore (11*a*) into contact with said anvil.

8. Tool, as set forth in claim 7, wherein said anvil (13) comprises said driving member (13*b*) for receiving the fastening elements (12) and for securing the fastening element so that it rotates with said anvil and said receiving body (11).

9. Tool, as set forth in claim 1, wherein the fastening element comprises a drill head (12*e*, 41*d*) located at one end of a shank, and load application means (12*a*, 41*a*) located at an opposite end of said shank, and rotary driving means (12*b*, 41*a*) at the opposite end of the shank for engagement with said first means for rotating and applying pressure blows to the fastening element.

10. Tool, as set forth in claim 1, wherein a housing encloses said first and second means (1, 2).

11. Tool, as set forth in claim 10, wherein said housing comprises a first housing part (1) containing said first means and a second housing part (1) containing said second means, said first and second housing parts being disengageably connected together.

12. Tool, as set forth in claim 11, wherein said second means comprises an axially extending guide tube (35) in said second housing part, an axially extending piston (37) is located within said guide tube (35) and extends into said first housing part (1), said guide tube (35) has a cartridge chamber (35*b*) located at an end thereof more remote from said first housing part (1) and said cartridge chamber opens into said guide tube for propelling said piston when an explosive powder charge cartridge is ignited within said cartridge chamber.

13. Tool, for driving fastening elements into a hard receiving material such as concrete, masonry, rock and the like, wherein the improvement comprises first means (1) for rotating a fastening element and drilling the fastenening element into the receiving material, and a separate second means (2) for axially driving the fastening element after the fastening element has been drilled into the receiving material, said first means comprises a receiving body (11, 42) arranged to receive the fastening element (12, 41) so that the fastening element rotates with the receiving body and is axially displaceable relative to the receiving body, said receiving body comprises at least one driving member (13*b*, 42*b*) for interengagement with the fastening element (12, 41) so that the fastening element is secured for rotation with the receiving body, said receiving body has an axially extending bore (11*a*, 42*a*), said second means comprises a driving piston (37) having an axially extending shaft (37*b*) with the shaft (37*b*) being axially displaceable through said bore (11*a*, 42*a*) when said driving piston (37) is displaced axially by high-pressure gases, and said drive member (9) has a bore (9*e*) coaxial with said bore (11*a*, 42*a*) in said receiving body (11), and said striker (17) and said driving piston (37) are arranged to pass axially through said bore (9*e*) in said drive member which opens to the bore (11*a*) in the receiving body (11, 42).

* * * * *